US008531358B2

(12) United States Patent
Choi et al.

(10) Patent No.: US 8,531,358 B2
(45) Date of Patent: Sep. 10, 2013

(54) ORGANIC LIGHT EMITTING DISPLAY DEVICE HAVING IMPROVED BRIGHTNESS

(75) Inventors: Sang-Moo Choi, Yongin (KR); Chul-Kyu Kang, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 200 days.

(21) Appl. No.: 12/683,189

(22) Filed: Jan. 6, 2010

(65) Prior Publication Data

US 2010/0245402 A1 Sep. 30, 2010

(30) Foreign Application Priority Data

Mar. 26, 2009 (KR) ..... 10-2009-0025841

(51) Int. Cl.
*G09G 3/30* (2006.01)

(52) U.S. Cl.
USPC ..... 345/76

(58) Field of Classification Search
USPC ..... 345/76–78
See application file for complete search history.

(56) References Cited

U.S. PATENT DOCUMENTS

| | | | | |
|---|---|---|---|---|
| 2004/0026723 | A1 | 2/2004 | Miyazawa | |
| 2005/0140605 | A1* | 6/2005 | Jung | 345/76 |
| 2006/0267884 | A1* | 11/2006 | Takahashi et al. | 345/76 |
| 2007/0024544 | A1 | 2/2007 | Chung et al. | |
| 2007/0063932 | A1 | 3/2007 | Nathan et al. | |
| 2007/0126665 | A1 | 6/2007 | Kimura | |
| 2007/0268217 | A1 | 11/2007 | Ahn et al. | |
| 2008/0211747 | A1 | 9/2008 | Kim | |

FOREIGN PATENT DOCUMENTS

| | | | |
|---|---|---|---|
| CA | 2 557 713 | A1 | 11/2006 |
| CN | 101075407 | A | 11/2007 |
| CN | 101256732 | A | 9/2008 |
| CN | 101305409 | A | 11/2008 |
| EP | 2 192 571 | A2 | 6/2010 |
| JP | 2006-113586 | | 4/2006 |
| JP | 2007-140318 | | 6/2007 |
| JP | 2007-206590 | | 8/2007 |
| JP | 2008-026467 | | 2/2008 |
| JP | 2008-176287 | | 7/2008 |
| JP | 2008-241783 | | 10/2008 |
| KR | 10-2005-0025510 | A | 3/2005 |

(Continued)

OTHER PUBLICATIONS

Korean Office action dated Jul. 18, 2011 issued in corresponding priority application No. 10-2009-0025841, 1 page.

(Continued)

*Primary Examiner* — Allison Walthall
(74) *Attorney, Agent, or Firm* — Christie, Parker & Hale, LLP

(57) ABSTRACT

An organic light emitting display device compensates for a variation of the threshold voltage of a driving transistor. A scan driver and a data driver drive a plurality of pixels. A pixel of the pixels includes an organic light emitting diode, four transistors, and two capacitors. A first transistor controls a current to the organic light emitting diode. Second and third transistors are coupled between a data line from the data driver and a gate electrode of the first transistor. A fourth transistor is coupled between a reference power supply and the gate electrode of the first transistor. The two capacitors are coupled between the organic light emitting diode and respective electrodes of the third transistor.

7 Claims, 5 Drawing Sheets

(56) References Cited

FOREIGN PATENT DOCUMENTS

| | | | |
|---|---|---|---|
| KR | 10-2007-0112714 | | 11/2007 |
| KR | 1020070118857 | A | 12/2007 |
| KR | 10-2008-0001482 | A | 1/2008 |
| KR | 10-2008-0062307 | A | 7/2008 |
| KR | 10-2008-0080754 | | 9/2008 |
| KR | 10-2008-0080755 | A | 9/2008 |
| KR | 10-2008-0084017 | | 9/2008 |
| KR | 10-0858618 | B1 | 9/2008 |
| WO | WO 2005/036515 | A1 | 4/2005 |
| WO | WO 2008/075697 | | 6/2008 |

OTHER PUBLICATIONS

Japanese Office action dated Mar. 13, 2012 issued to Japanese Application No. 2009-207021 which claims priority to corresponding Korean priority application No. 10-2009-0025841, 1 page.

European Search Report dated May 7, 2010 for European Patent application 09176250.0, (11 pages).

KIPO Office action dated Sep. 6, 2010 for Korean Patent application 10-2008-0118055, (2 pages).

U.S. Office action dated Mar. 1, 2012, for cross reference U.S. Appl. No. 12/603,556, (15 pages).

Japanese Office action dated Feb. 7, 2012 for Japanese Patent application 2009-021682, (1 page).

Japanese Office action dated Jul. 10, 2012 for Japanese Patent application 2009-021682, (3 pages).

SIPO Patent Gazette dated Dec. 12, 2012, for corresponding Chinese Patent application 200910205439.7, with English translaiton of p. 1 only, (3 pages).

SIPO Patent Gazette dated Mar. 6, 2013, for corresponding Chinese Patent application 201010125570.5, with English translation of cover page only, (3 pages).

European Patent Gazette EP 2 234 093 dated May 16, 2012, for corresponding European Patent application 10157704.7, (1 page).

* cited by examiner

ORGANIC LIGHT EMITTING DISPLAY DEVICE HAVING IMPROVED BRIGHTNESS

CROSS-REFERENCE TO RELATED APPLICATIONS

This application claims priority to and the benefit of Korean Patent Application No. 10-2009-0025841, filed on Mar. 26, 2009, in the Korean Intellectual Property Office, the entire content of which is incorporated herein by reference.

BACKGROUND

1. Field

The following description relates to organic light emitting display devices.

2. Discussion of Related Art

Recently, various flat panel display devices capable of reducing weight and volume, which are disadvantages of cathode ray tubes, have been developed. Among the flat panel display devices, there are liquid crystal display devices, field emission display devices, plasma display panels, and organic light emitting display devices, etc.

Among the above discussed flat panel display devices, the organic light emitting display devices display images using organic light emitting diodes that generate light by the recombination of electrons and holes. Organic light emitting display devices are driven at low power consumption, with rapid response speed.

FIG. 1 is a schematic circuit diagram showing a conventional pixel of an organic light emitting display device. In FIG. 1, the transistors included in the pixel are NMOS transistors.

Referring to FIG. 1, the pixel 4 of the conventional organic light emitting display device includes a pixel circuit 2 that is coupled to an organic light emitting diode OLED, a data line Dm, and a scan line Sn to control the organic light emitting diode OLED.

The anode electrode of the organic light emitting diode OLED is coupled to the pixel circuit 2, and the cathode electrode of the organic light emitting diode OLED is coupled to a second power supply ELVSS. The organic light emitting diode OLED generates light having a brightness (e.g., a predetermined brightness) corresponding to the current supplied from the pixel circuit 2.

The pixel circuit 2 controls the amount of current supplied to the organic light emitting diode OLED according to the data signal supplied to the data line Dm and a scan signal supplied to the scan line Sn. To this end, the pixel circuit 2 includes a second transistor M2 (i.e., a driving transistor) coupled between a first power supply ELVDD and the organic light emitting diode OLED, a first transistor M1 coupled between the second transistor M2, the data line Dm, and the scan line Sn, and a storage capacitor Cst that is coupled between the gate electrode and a first electrode of the second transistor M2.

The gate electrode of the first transistor M1 is coupled to the scan line Sn, and a first electrode of the first transistor M1 is coupled to the data line Dm. A second electrode of the first transistor M1 is coupled to one terminal of the storage capacitor Cst. Here, the first electrode of the first transistor M1 is either a source electrode or a drain electrode, and the second electrode of the first transistor M1 is an electrode other than the electrode of the first electrode. For example, if the first electrode is the source electrode, the second electrode is the drain electrode. When the scan signal is supplied to the scan line Sn, the first transistor M1 coupled between the scan line Sn and the data line Dm is turned on to supply the data signal supplied from the data line Dm to the storage capacitor Cst. Thus, the storage capacitor Cst is charged with a voltage corresponding to the data signal.

The gate electrode of the second transistor M2 is coupled to one terminal of the storage capacitor Cst, and the first electrode is coupled to the first power supply ELVDD. The second electrode of the second transistor M2 is coupled to the other terminal of the storage capacitor Cst and is also coupled to the anode electrode of the organic light emitting diode OLED. The second transistor M2 controls the amount of current flowing from the first power supply ELVDD to the second power supply ELVSS via the organic light emitting diode OLED in accordance with the voltage stored in the storage capacitor Cst.

One terminal of the storage capacitor Cst is coupled to the gate electrode of the second transistor M2, and the other terminal of the storage capacitor Cst is coupled to the anode electrode of the organic light emitting diode OLED. The storage capacitor Cst is charged with the voltage corresponding to the data signal.

A conventional pixel 4 as described above supplies a current corresponding to the voltage charged in the storage capacitor Cst to the organic light emitting diode OLED, thereby displaying an image having a brightness (e.g., a predetermined brightness). However, an issue with this conventional organic light emitting display device is that it cannot display an image having a uniform brightness due to the deviation of the threshold voltage of the second transistor M2.

Actually, when the threshold voltage of the second transistors M2 are different in the respective pixels 4, the respective pixels 4 generate light having different brightness corresponding to the same data signal, and the conventional organic light emitting display device cannot display an image having a uniform brightness.

SUMMARY

An aspect of an embodiment of the present invention provides an organic light emitting display device that compensates for variations of the threshold voltage of driving transistors.

According to an embodiment of the present invention, an organic light emitting display device includes a scan driver for sequentially supplying scan signals to a plurality of scan lines; a data driver for supplying an initial power during a first portion of a period when the scan signals are supplied to the scan lines, and for supplying data signals during a second portion of the period other than the first portion of the period; and pixels at respective crossings of the scan lines and the data lines. A pixel of the pixels at an $i^{th}$ (i is a natural number) horizontal line includes an organic light emitting diode having a cathode electrode coupled to a second power supply; a first transistor for controlling a current flowing from a first power supply to the second power supply via the organic light emitting diode; a second transistor coupled between a data line of the data lines and a second node, and is configured to be turned on when a scan signal of the scan signals is supplied to an $i^{th}$ scan line; a third transistor coupled between a first node coupled to the gate electrode of the first transistor and the second node, and is configured to maintain a turn-off state when the second transistor is turned on; a fourth transistor coupled between the first node and a reference power supply, and is configured to be turned on when the scan signal is supplied to the $i^{th}$ scan line; a first capacitor coupled between the second node and an anode electrode of the organic light emitting diode; and a second capacitor coupled between the first node and the anode electrode of the organic light emitting diode.

In some embodiments, the initial power is adapted to have a higher voltage than a voltage of the data signal. The reference power may have a voltage adapted to turn off the first transistor. The third transistor may be configured to be turned on when the scan signal is supplied to an $i+1^{th}$ scan line. The scan driver may be configured sequentially to supply emission control signals to emission control lines substantially parallel to the scan lines. The emission control signal supplied to an $i^{th}$ emission control line may overlap the scan signal supplied to the $i^{th}$ scan line, and may have a voltage adapted to turn off the third transistor. The gate electrode of the third transistor may be coupled to the $i^{th}$ emission control line.

With the organic light emitting display device according to various embodiments of the present invention, the threshold voltage of the driving transistor is substantially compensated, thus displaying an image having a substantially uniform brightness.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
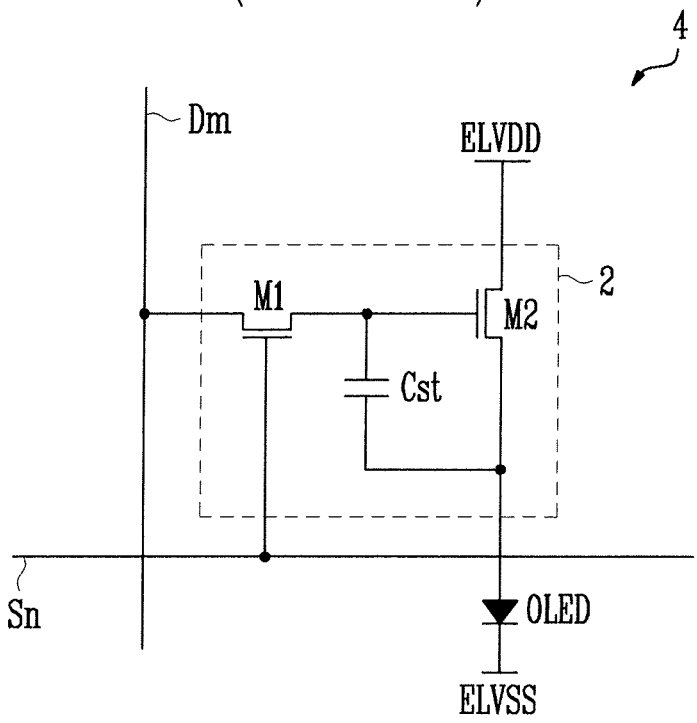
FIG. 1 (PRIOR ART)
FIG. 1 is a schematic circuit diagram showing a conventional pixel of an organic light emitting display device.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being coupled to another element, it can be directly coupled to the another element or be indirectly coupled to the another element with one or more intervening elements interposed therebetween. Like reference numerals designate like elements throughout the specification.

Hereinafter, exemplary embodiments of the present invention, proposed so that a person having ordinary skill in the art can easily carry out the present invention, will be described in more detailed with reference to the accompanying FIG. 2 to FIG. 6.

Figure 2:
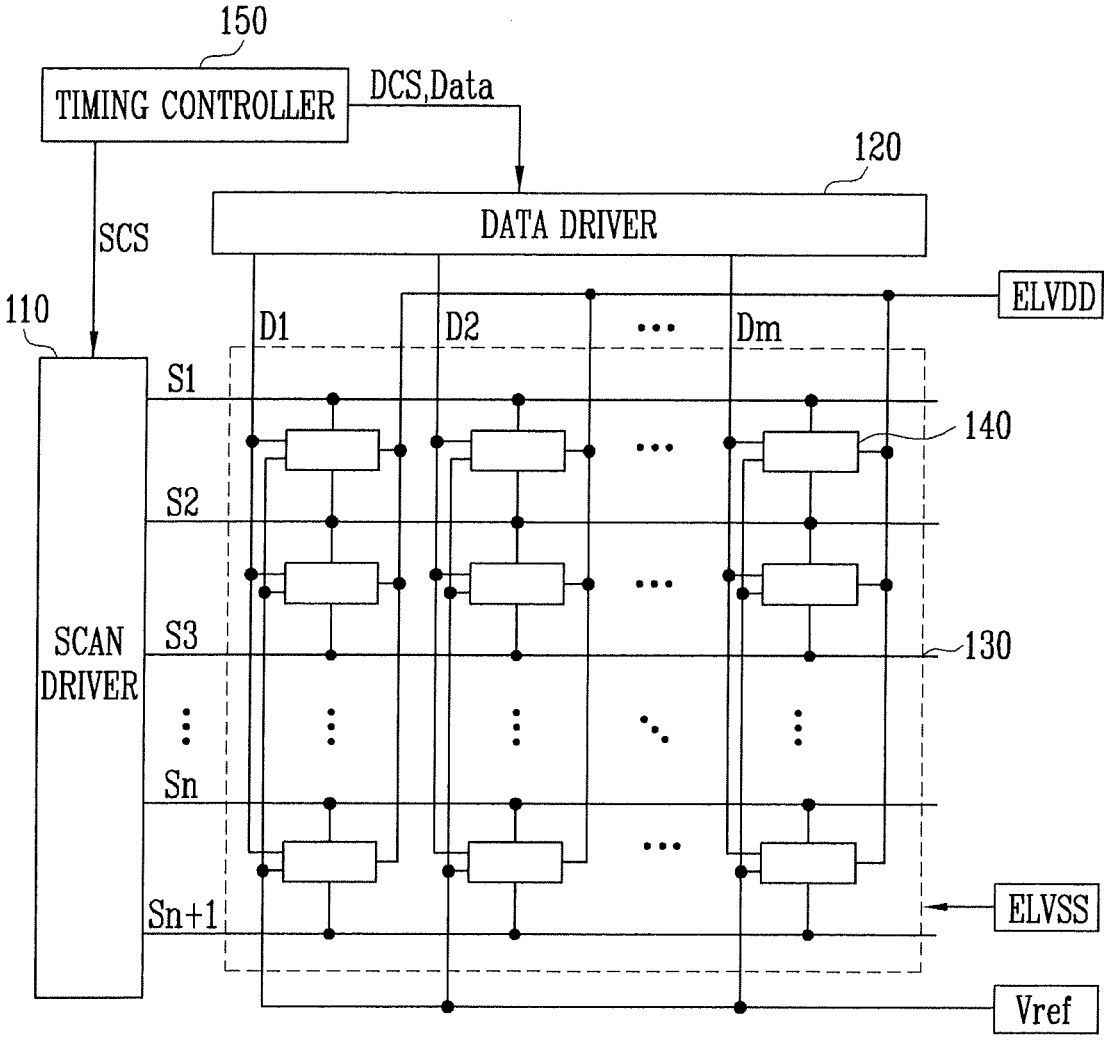
FIG. 2 is a schematic block diagram showing an organic light emitting display device according to an embodiment of the present invention.

FIG. 2 is a schematic block diagram showing an organic light emitting display device according to an exemplary embodiment of the present invention.

Referring to FIG. 2, the organic light emitting display device according to the exemplary embodiment of the present invention includes pixels 140 positioned to be coupled to scan lines S1 to Sn+1 and data lines D1 to Dm, a scan driver 110 that drives the scan lines S1 to Sn+1, a data driver 120 that drives the data lines D1 to Dm, and a timing controller 150 that controls the scan driver 110 and the data driver 120.

The scan driver 110 receives a scan driving control signal SCS from the timing controller 150. The scan driver 110 supplied with the scan driving control signal SCS generates scan signals, and sequentially supplies the generated scan signals to the scan lines S1 to Sn+1.

The data driver 120 receives a data driving control signal DCS from the timing controller 150. The data driver 120 supplied with the data driving control signal DCS supplies an initial power during a first period of the period when the scan signals are supplied and supplies the data signals during a second period other than the first period. Here, the initial power is set to have a higher voltage than the data signals.

The timing controller 150 generates the data driving control signal DCS and the scan driving control signal SCS corresponding to synchronization signals supplied from an external source. The data driving control signal DCS generated by the timing controller 150 is supplied to the data driver 120, and the scan driving control signal SCS generated by the timing controller 150 is supplied to the scan driver 110. The timing controller 150 supplies data Data, which is supplied from the external source, to the data driver 120.

The pixel unit 130 receives a first power ELVDD, a second power ELVSS, and a reference power Vref from the external source, and supplies them to the respective pixels 140. The respective pixels 140 supplied with the first power ELVDD, the second power ELVSS, and the reference power Vref generate light in accordance with the data signal.

Here, the first power supply ELVDD is set to have a higher voltage than the second power supply ELVSS to supply a current (e.g., a predetermined current) to the organic light emitting diode OLED. The reference power Vref has a voltage adapted to turn off the driving transistor.

In addition, the pixel 140 positioned at an $i^{th}$ (i is a natural number) horizontal line is coupled to an $i^{th}$ scan line and an $i+1^{th}$ scan line. The pixel 140 includes a plurality of NMOS-type transistors and supplies the current, which is compensated for variations of the threshold voltage of the driving transistor, to the organic light emitting diode OLED.

Figure 3:
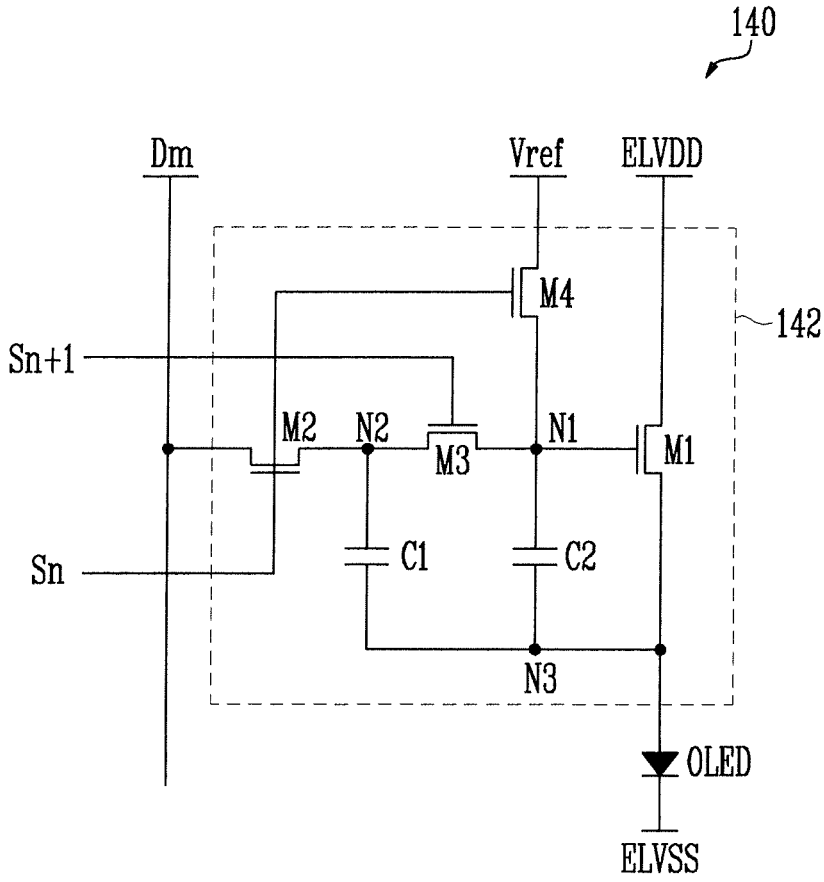
FIG. 3 is a schematic circuit diagram showing another embodiment of the exemplary embodiment of FIG. 2.

FIG. 3 is a schematic circuit diagram showing a pixel according to an embodiment of the present invention. For convenience of explanation, FIG. 3 shows the pixel 140 positioned on a $n^{th}$ horizontal line and coupled to an $m^{th}$ data line Dm.

Referring to FIG. 3, the pixel 140 according to the exemplary embodiment of the present invention includes a pixel circuit 142 that is coupled to an organic light emitting diode OLED, the $m^{th}$ data line Dm, $n^{th}$ scan line Sn, and $n+1^{th}$ scan line Sn+1 to control the organic light emitting diode OLED.

An anode electrode of the organic light emitting diode OLED is coupled to the pixel circuit 142, and a cathode electrode of the organic light emitting diode OLED is coupled to the second power supply ELVSS. The organic light emitting diode OLED generates light having a brightness (e.g., a predetermined brightness) corresponding to the current supplied from the pixel circuit 142.

The pixel circuit 142 is charged with a voltage corresponding to a data signal supplied to the $m^{th}$ data line Dm when the scan signal is supplied to the $n^{th}$ scan line Sn, and corresponding to the threshold voltage of a first transistor M1 (that is, a driving transistor), and supplies the current corresponding to the charged voltage when the scan signal is supplied to the $n+1^{th}$ scan line Sn+1 to the organic light emitting diode OLED. To this end, the pixel circuit 142 includes first to fourth transistors M1 to M4, a first capacitor C1, and a second capacitor C2.

A gate electrode of the first transistor M1 is coupled to a first node N1, and a first electrode of the first transistor M1 is coupled to a first power supply ELVDD. A second electrode of the first transistor M1 is coupled to the anode electrode of the organic light emitting diode OLED (i.e., to a third node N3). The first transistor M1 controls the amount of current supplied from the first power supply ELVDD to the second power supply ELVSS via the organic light emitting diode OLED in accordance with the voltage applied to the first node N1.

A gate electrode of the second transistor M2 is coupled to the $n^{th}$ scan line Sn, and a first electrode of the second transistor M2 is coupled to the $m^{th}$ data line Dm. A second electrode of the second transistor M2 is coupled to a second node N2. The second transistor M2 is turned on when the scan signal is supplied to the $n^{th}$ scan line Sn to couple (e.g., to conductively couple) the data line Dm to the second node N2.

A gate electrode of the third transistor M3 is coupled to the $n+1^{th}$ scan line Sn+1, and a first electrode of the third transistor M3 is coupled to the second node N2. A second electrode of the third transistor M3 is coupled to the first node N1 (that is, the gate electrode of the first transistor M1). The third transistor M3 is turned on when the scan signal is supplied to the $n+1^{th}$ scan line Sn+1 to couple (e.g., to conductively couple) the first node N1 to the second node N2. Meanwhile, the third transistor M3 maintains a turn-off state when the second transistor M2 is turned on.

A gate electrode of the fourth transistor M4 is coupled to the $n^{th}$ scan line Sn, and a first electrode of the fourth transistor M4 is coupled to the reference power Vref. A second electrode of the fourth transistor M4 is coupled to the first node N1. The fourth transistor M4 is turned on when the scan signal is supplied to the $n^{th}$ scan line Sn to supply the voltage of the reference power Vref to the first node N1.

The first capacitor C1 is coupled between the second node N2 and a third node N3 (that is, the anode electrode of the organic light emitting diode OLED). Thus, the first capacitor C1 is charged with the voltage corresponding to the data signal when the second transistor M2 is in a turn-on state.

The second capacitor C2 is coupled between the first node N1 and the third node N3 (that is, the anode electrode of the organic light emitting diode OLED). Thus, the second capacitor C2 is charged with the voltage corresponding to the threshold voltage of the first transistor M1.

Figure 4:
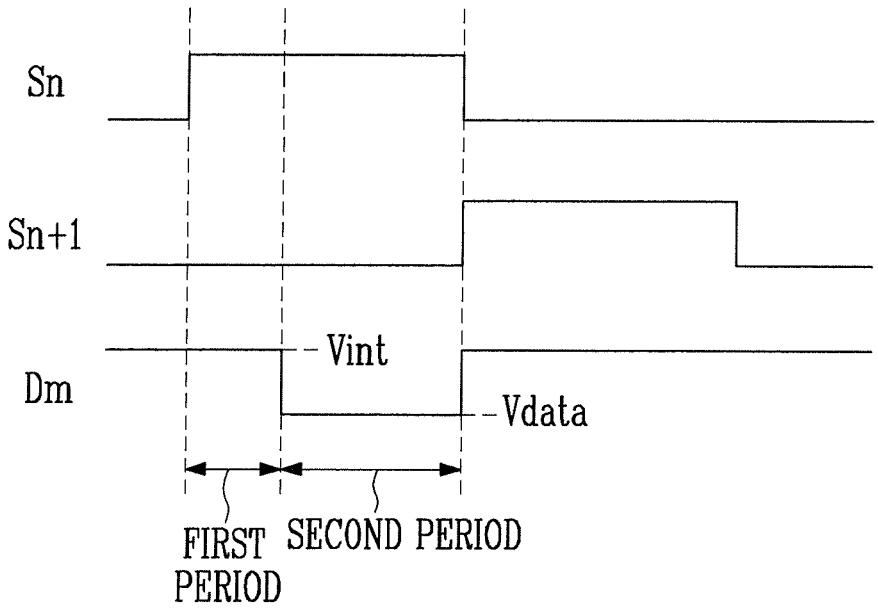
FIG. 4 is a waveform timing diagram showing a method for driving the pixel of FIG. 3.

FIG. 4 is a waveform timing diagram showing a method for driving the pixel of FIG. 3.

Describing the operation process of the pixel 140 in detail by combining FIGS. 3 and 4, the scan signal is first supplied to the $n^{th}$ scan line Sn, and an initial power Vint is supplied to the $m^{th}$ data line Dm during a first period of the period when the scan signal is supplied.

When the scan signal is supplied to the scan line Sn, the second transistor M2 and the fourth transistor M4 are turned on. When the fourth transistor M4 is turned on, the voltage of the reference power supply Vref is supplied to the first node N1. Here, the voltage of the reference power supply Vref has a low voltage, which maintains the first transistor M1 in a turn-off state. When the first transistor M1 is turned off, the current is not supplied to the organic light emitting diode OLED, and accordingly, the organic light emitting diode OLED is in a turn-off state.

When the second transistor M2 is turned on, the initial power Vint from the $m^{th}$ data line Dm is supplied to the second node N2. In this case, both terminals of the first capacitor C1 are set to the initial power Vint and the voltage applied to the anode electrode of the organic light emitting diode OLED at the time of turn-off.

Thereafter, the data signal is supplied to the $m^{th}$ data line Dm during a second period, and accordingly, the voltage of the second node N2 falls from the initial voltage Vint to the voltage of the data signal Vdata. If the voltage of the second node N2 falls, the voltage of the third node N3 also falls by a coupling phenomenon of the first capacitor C1. Here, the first transistor M1 is turned on, and the voltage of the third node N3 rises to the voltage obtained by subtracting the threshold voltage of the first transistor M1 from the voltage of the reference power supply Vref. To this end, the voltage of the reference power supply Vref is set so that the voltage of the third node N3 falls to a lower voltage than the voltage of the reference power supply Vref when the data signal is supplied.

When the voltage of the third node N3 rises to the voltage obtained by subtracting the threshold voltage of the first transistor M1 from the voltage of the reference power supply Vref, the second capacitor C2 is charged with the threshold voltage of the first transistor M1. Here, the first capacitor C1 is charged with the voltage obtained by the equation Vdata−Vref+Vth(M1). Here, Vdata represents the voltage of the data signal.

Thereafter, the supply of the scan signal to the $n^{th}$ scan line Sn stops, and the second transistor M2 and the fourth transistor M4 are turned off. The scan signal is supplied to the $n+1^{th}$ scan line Sn+1, so the third transistor M3 is turned on. When the third transistor M3 is turned on, the first node N1 and the second node N2 are coupled (e.g., conductively coupled) to each other. Then, the voltage stored in the first capacitor C1 and the second capacitor C2 are shared and averaged. In this case, the voltage finally applied to the first node and the second node N2 are shown in equation 1:

$$V_{N1,N2}=(C1\times V\text{data}+C2\times Vref)/(C1+C2) \quad \text{[Equation 1]}$$

The voltage of the third node N3 is set as shown in equation 2:

$$V_{N3}=Vref-Vth(M1) \quad \text{[Equation 2]}$$

When the voltages of the nodes N1, N2, and N3 are set as shown in equations 1 and 2, a gate-source voltage Vgs of the first transistor M1 is shown in equation 3:

$$Vgs=(C1\times V\text{data}+C2\times Vref)/(C1+C2)-Vref+Vth(M1) \quad \text{[Equation 3]}$$

When the gate-source voltage Vgs of the first transistor M1 is as shown in equation 3, the current flowing through the organic light emitting diode OLED is as shown in equation 4:

$$\begin{aligned} loled &= \beta(Vgs - Vth(M1)^2 \quad \text{[Equation 4]} \\ &= \beta\{(C1\times Vdata + C2\times Vref)/(C1+C2) - Vref + Vth(M1) - Vth(M1\}^2 \\ &= \beta\{(C1\times Vdata + C2\times Vref)/(C1+C2) - Vref\}^2 \end{aligned}$$

Referring to equation 4, the current flowing through the organic light emitting diode OLED is determined irrespective (or substantially independent) of the threshold voltage of the first transistor M1. Therefore, in an embodiment of the present invention, an image having a substantially uniform brightness can be displayed.

Figure 5:
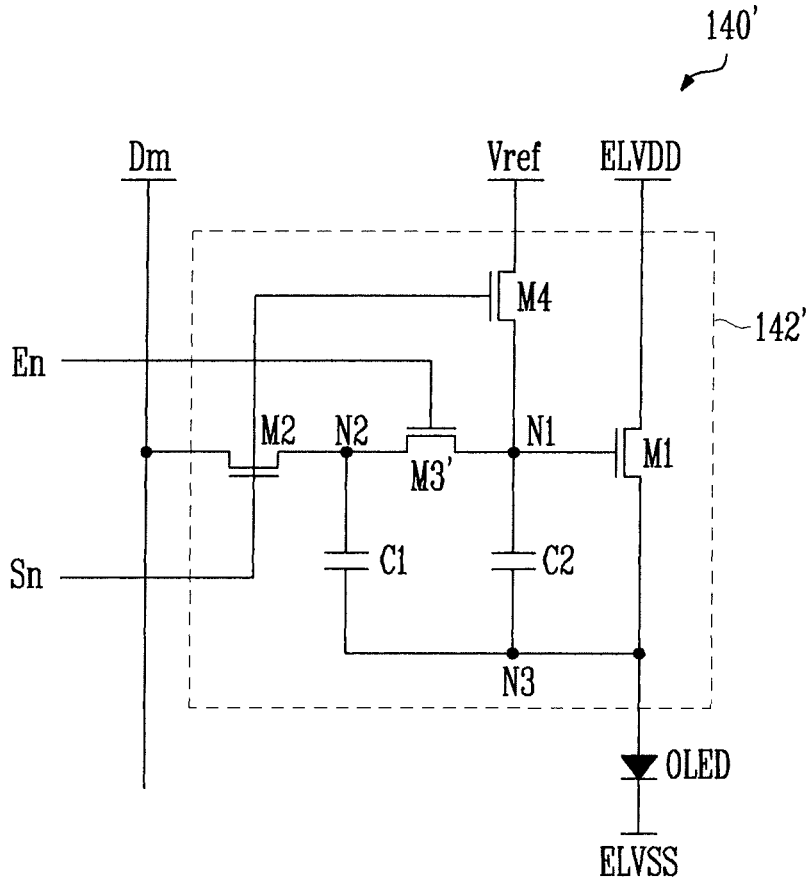
FIG. 5 is a schematic circuit diagram showing another embodiment of the exemplary embodiment of FIG. 2.

FIG. 5 is a schematic circuit diagram showing a pixel according to another embodiment of the present invention. When describing FIG. 5, portions having the same structure and/or function as FIG. 3 will be given with the same reference numerals and the detailed description thereof will be omitted.

Figure 6:
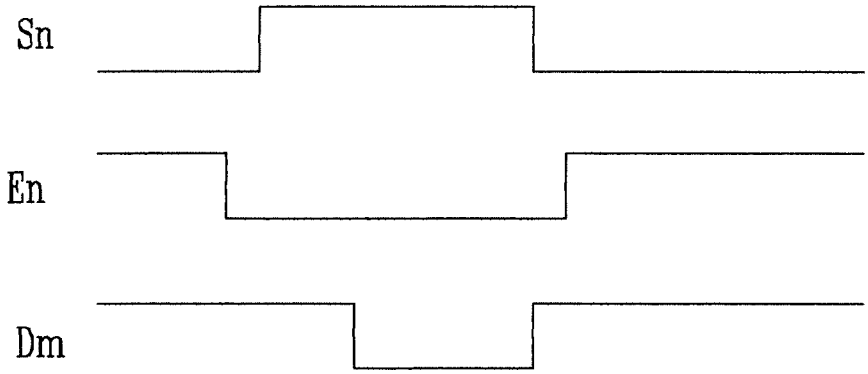
FIG. 6 is a waveform timing diagram showing a method for driving the pixel of FIG. 5.

Referring to FIG. 5, the pixel 140' is coupled to an emission control line En. Here, the emission control lines are formed for each horizontal line to be substantially parallel to the scan lines S1 to Sn. An emission control signal supplied to an $i^{th}$ (i is a natural number) emission control line Ei is supplied to overlap in time with the scan signal supplied to an $i^{th}$ scan line Si, as shown in FIG. 6.

Meanwhile, the scan signals sequentially supplied to the scan lines S1 to Sn have a voltage (for example, having a high polarity) that turns on the corresponding transistors, and the emission control signals supplied to the emission control lines E1 to En have a voltage (for example, having a low polarity) that turns off the corresponding transistors.

A gate electrode of the third transistor M3' included in the pixel circuit 142' is coupled to the emission control line En, and a first electrode of the third transistor M3' is coupled to the second node N2. A second electrode of the third transistor M3 is coupled to the first node N1.

The operation process of the pixel 140' as described above is substantially the same as that of the pixel shown in FIG. 3, except that the third transistor M3' is controlled by the emission control signal. Therefore, the detailed operation process thereof will not be provided again.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a scan driver for sequentially supplying scan signals to a plurality of scan lines;

a data driver for supplying an initial power to a plurality of data lines, respectively, during a first portion of a period when the scan signals are supplied to the scan lines, and for supplying data signals during a second portion of the period other than the first portion of the period; and pixels at respective crossings of the scan lines and the data lines, wherein a pixel of the pixels at an $i^{th}$ (i is a natural number) horizontal line comprises:

an organic light emitting diode having a cathode electrode coupled to a second power supply;

a first transistor for controlling a current flowing from a first power supply to the second power supply via the organic light emitting diode;

a second transistor coupled between a data line of the data lines and a second node, the second transistor configured to be turned on when a scan signal of the scan signals is supplied to an $i^{th}$ scan line of the scan lines;

a third transistor directly coupled between a first node coupled to the gate electrode of the first transistor and the second node, the third transistor configured to maintain a turn-off state when the second transistor is turned on;

a fourth transistor coupled between the first node and a reference power supply, the fourth transistor configured to be turned on when the scan signal is supplied to the $i^{th}$ scan line;

a first capacitor coupled between the second node and an anode electrode of the organic light emitting diode; and a second capacitor directly coupled between the first node and the anode electrode of the organic light emitting diode.

2. The organic light emitting display device as claimed in claim 1, wherein the initial power has a higher voltage than a voltage of the data signal.

3. The organic light emitting display device as claimed in claim 1, wherein the reference power supply is configured to supply a voltage for turning off the first transistor.

4. The organic light emitting display device as claimed in claim 1, wherein the third transistor is configured to be turned on when the scan signal is supplied to an $i+1^{th}$ scan line.

5. The organic light emitting display device as claimed in claim 1, wherein the scan driver is configured sequentially to supply emission control signals to a plurality of emission control lines substantially parallel to the scan lines.

6. The organic light emitting display device as claimed in claim 5, wherein the emission control signal supplied to an $i^{th}$ emission control line of the emission control lines overlaps the scan signal supplied to the $i^{th}$ scan line, and has a voltage for turning off the third transistor.

7. The organic light emitting display device as claimed in claim 6, wherein a gate electrode of the third transistor is coupled to the $i^{th}$ emission control line.

* * * * *

UNITED STATES PATENT AND TRADEMARK OFFICE

CERTIFICATE OF CORRECTION

PATENT NO. : 8,531,358 B2
APPLICATION NO. : 12/683189
DATED : September 10, 2013
INVENTOR(S) : Sang-Moo Choi et al.

It is certified that error appears in the above-identified patent and that said Letters Patent is hereby corrected as shown below:

| | |
|---|---|
| On the Title Page, Pg. 2<br>Item (56) References Cited, Other Publications,<br>Col. 2, line 10 | Delete "translaiton",<br>Insert -- translation -- |

Signed and Sealed this
Thirtieth Day of December, 2014

Michelle K. Lee

Michelle K. Lee
*Deputy Director of the United States Patent and Trademark Office*